US007168274B2

(12) United States Patent
Slutsky et al.

(10) Patent No.: US 7,168,274 B2
(45) Date of Patent: Jan. 30, 2007

(54) COMBINATION WASHER/DRYER HAVING COMMON HEAT SOURCE

(75) Inventors: Dennis Slutsky, Fall River, MA (US); Craig F. Bliss, Taunton, MA (US)

(73) Assignee: American Dryer Corporation, Fall River, MA (US)

( * ) Notice: Subject to any disclaimer, the term of this patent is extended or adjusted under 35 U.S.C. 154(b) by 181 days.

(21) Appl. No.: 10/428,994

(22) Filed: May 5, 2003

(65) Prior Publication Data

US 2004/0221474 A1 Nov. 11, 2004

(51) Int. Cl.
*D06F 25/00* (2006.01)

(52) U.S. Cl. ..... 68/19; 68/19.1; 68/20; 68/24; 68/140

(58) Field of Classification Search ..... 68/19, 68/19.1, 19.2, 20, 24, 140; 34/526, 527, 34/573, 60

See application file for complete search history.

(56) References Cited

U.S. PATENT DOCUMENTS 1,593,678 A * 7/1926 Statler ..... 68/13 R
2,057,887 A * 10/1936 Elliott et al. ..... 210/786
2,142,995 A * 1/1939 Busi ..... 68/25
2,201,685 A * 5/1940 Lorenzen ..... 68/19.2
2,283,612 A * 5/1942 Perry ..... 68/19.2
2,360,985 A * 10/1944 Sherbondy ..... 34/76
2,453,859 A * 11/1948 Pugh ..... 34/60
2,652,708 A * 9/1953 Rimsha et al. ..... 68/20
2,720,037 A * 10/1955 Erickson ..... 34/526
2,793,518 A * 5/1957 Geldhof ..... 68/19.2
2,797,567 A * 7/1957 Sigurd ..... 68/16
2,816,429 A * 12/1957 Kurlancheek ..... 68/19.2
2,818,719 A * 1/1958 Cline ..... 68/19.2
2,868,004 A * 1/1959 Runde ..... 68/12.15
2,885,877 A * 5/1959 Denker ..... 68/156

(Continued)

FOREIGN PATENT DOCUMENTS

DE 44 26 802 * 2/1996

(Continued)

OTHER PUBLICATIONS

European Paten Office 0 816 549 Jan. 1998.*

(Continued)

*Primary Examiner*—Frankie L. Stinson
(74) *Attorney, Agent, or Firm*—Barlow, Josephs & Holmes, Ltd.

(57) ABSTRACT

The combination washer/dryer and method for operating a combination washer/dryer. The washer/dryer has a containment drum which receives wash water, and includes a perforated clothes drum which rotates within the containment drum. A heat plenum is provided in heat transfer relationship with the containment drum, and a source of heat coupled to the heat plenum supplies heat for water in the containment drum. During a drying cycle, hot air from the heat source supplied from the fire box to the containment drum for heating wash water during a washing cycle, and for supplying hot air during a drying cycle. A drying air plenum is connected to receive drying air from the source of heat, delivering the drying air to the top of the containment drum, where it enters the rotating basket. An exhaust plenum discharges hot air laden with moisture from the containment drum through a lint filter.

11 Claims, 6 Drawing Sheets

U.S. PATENT DOCUMENTS

| | | | | | |
|---|---|---|---|---|---|
| 2,892,335 | A | * | 6/1959 | Gray, Jr. | 68/16 |
| 2,491,389 | A | * | 6/1960 | Morrison | 68/20 |
| 2,986,917 | A | * | 6/1961 | Smith | 68/20 |
| 3,085,348 | A | * | 4/1963 | Adey et al. | 34/79 |
| 3,186,104 | A | | 6/1965 | Stilwell, Jr. | |
| 3,292,347 | A | * | 12/1966 | Hodgkinson | 261/83 |
| 3,306,596 | A | * | 2/1967 | Hollowell | 432/68 |
| 3,624,919 | A | * | 12/1971 | Miller | 34/607 |
| 3,889,390 | A | * | 6/1975 | Klare | 34/448 |
| 4,314,409 | A | | 2/1982 | Cartier et al. | |
| 4,448,347 | A | * | 5/1984 | Dunstan | 237/2 B |
| 4,462,170 | A | | 7/1984 | Burkall et al. | |
| 4,700,492 | A | * | 10/1987 | Werner et al. | 34/403 |
| 4,765,162 | A | | 8/1988 | Ouellette | |
| 5,143,528 | A | * | 9/1992 | Dongelmans | 55/283 |
| 5,210,960 | A | | 5/1993 | LaRue | |
| 5,226,203 | A | | 7/1993 | Sacconato et al. | |
| 5,499,640 | A | * | 3/1996 | Kirkland | 134/56 D |
| 5,560,120 | A | | 10/1996 | Swanson et al. | |
| 5,628,122 | A | * | 5/1997 | Spinardi | 34/79 |
| 5,694,795 | A | | 12/1997 | Knopp | |
| 6,269,667 | B1 | | 8/2001 | Back et al. | |
| 6,282,928 | B1 | | 9/2001 | Fukumoto et al. | |
| 6,327,731 | B2 | | 12/2001 | Back et al. | |
| 6,378,342 | B1 | | 4/2002 | Fukumoto et al. | |
| 2001/0027580 | A1 | | 10/2001 | Back et al. | |
| 2002/0020197 | A1 | | 2/2002 | Fukumoto et al. | |
| 2002/0073745 | A1 | | 6/2002 | Willis | |

FOREIGN PATENT DOCUMENTS

| | | | |
|---|---|---|---|
| JP | 4-40205 | * | 2/1992 |

OTHER PUBLICATIONS

International Search Report, Int'l Appl. No. PCT/US04/12830, dated Mar. 18, 2005, 4 pages.

* cited by examiner

COMBINATION WASHER/DRYER HAVING COMMON HEAT SOURCE

The present invention relates to laundry facilities. Specifically, a single device for both washing and drying clothes is disclosed using a common heat source for both washing and drying.

Commercial and home laundry facilities have typically required the use of separate appliances for washing and drying clothes, thereby dictating space requirements for the laundry facility. The machines are autonomous in that washing operations occur separate from drying operations, with independent washing and drying cycles and distinct operating controls of there own. A human operator must remove the clothes from the washer and load them in the dryer.

Commercial laundry facilities use larger capacity washing machines to wash clothes, linen and bedding. These facilities, including hospitals, nursing homes, hotels, etc., have a high volume of bedding, towels, and other common materials to wash and dry. Following the washing operation, an attendant must be available to transfer the washed materials to a separate large capacity dryer, and any delays in transferring the material results in a lower facility throughput.

The demands on commercial facilities for clean materials means that laundry facility throughput needs to be efficient and operating at a maximum level. The fact that washers and dryers are autonomous means that an attendant must promptly remove washed materials and load them in the dryer for maximum throughput efficiency, requiring the attention of at least one attendant who might otherwise be available for other tasks.

The high volume demands of these institutions typically means that a separate supply of hot water must be maintained on demand to meet the sanitary requirements for washing clothes which also impacts on space requirements.

The autonomous washing machine produces a load of centrifugally wrung materials which are transferred to a dryer at different times and at varying levels of moisture, depending on operator availability. In establishing an appropriate drying cycle, the beginning moisture level content of the wash load dictates, at least in part, the drying temperature and time for drying. In order to be certain that the drying temperature is at a safe level, so as not to scorch the dried materials, a lower, less than ideal temperature is set for the drying cycle. Accordingly, the drying cycle is longer and laundry throughput is lower than might otherwise be necessary due to each washed load having a different moisture content.

The present invention solves many of the foregoing problems which result from the use of separate autonomous washer and dryer appliances in a laundry facility.

SUMMARY OF THE INVENTION

The present invention provides for a single appliance and method for washing and drying clothes, particularly useful in a commercial laundry setting. In accordance with the invention, a combination washer/dryer is provided which has a common heat source for heating wash water and providing drying air during a drying cycle for the machine.

A sealed containment drum includes a rotating perforated clothes basket for rotating the load to be washed and dried. A water supply plenum extends around the rotating clothes basket and is in heat transfer relationship with a burner unit. The water plenum includes an outlet for discharging wash water through a controllable valve, as well as an inlet for receiving washing water. A drying air chamber extends from an opening in the top of the water plenum for delivering drying air from the heat source to the clothes basket, which passes through the perforated clothes basket to an exhaust chamber which discharges the moisture laden air.

In accordance with a preferred embodiment of the invention, the clothes basket is operated during a spin cycle to centrifugally remove a major quantity of water in the washed materials. In order to avoid caking, or compression of the wash load during a spin cycle, the spin cycle is alternately operated at a plurality of speeds, separated by pauses, to permit the clothing to separate from the wall of the perforated clothes drum.

In accordance with the preferred embodiment, a lint filter is supported in the exhaust chamber. The lint filter is cleaned by a jet of water directed to the lint screen, preferably prior to beginning a washing cycle, so that lint is forced from the filter surface down to the drain in the containment drum assembly to the waste water drain connection.

DESCRIPTION OF THE PREFERRED EMBODIMENT

Figure 1:
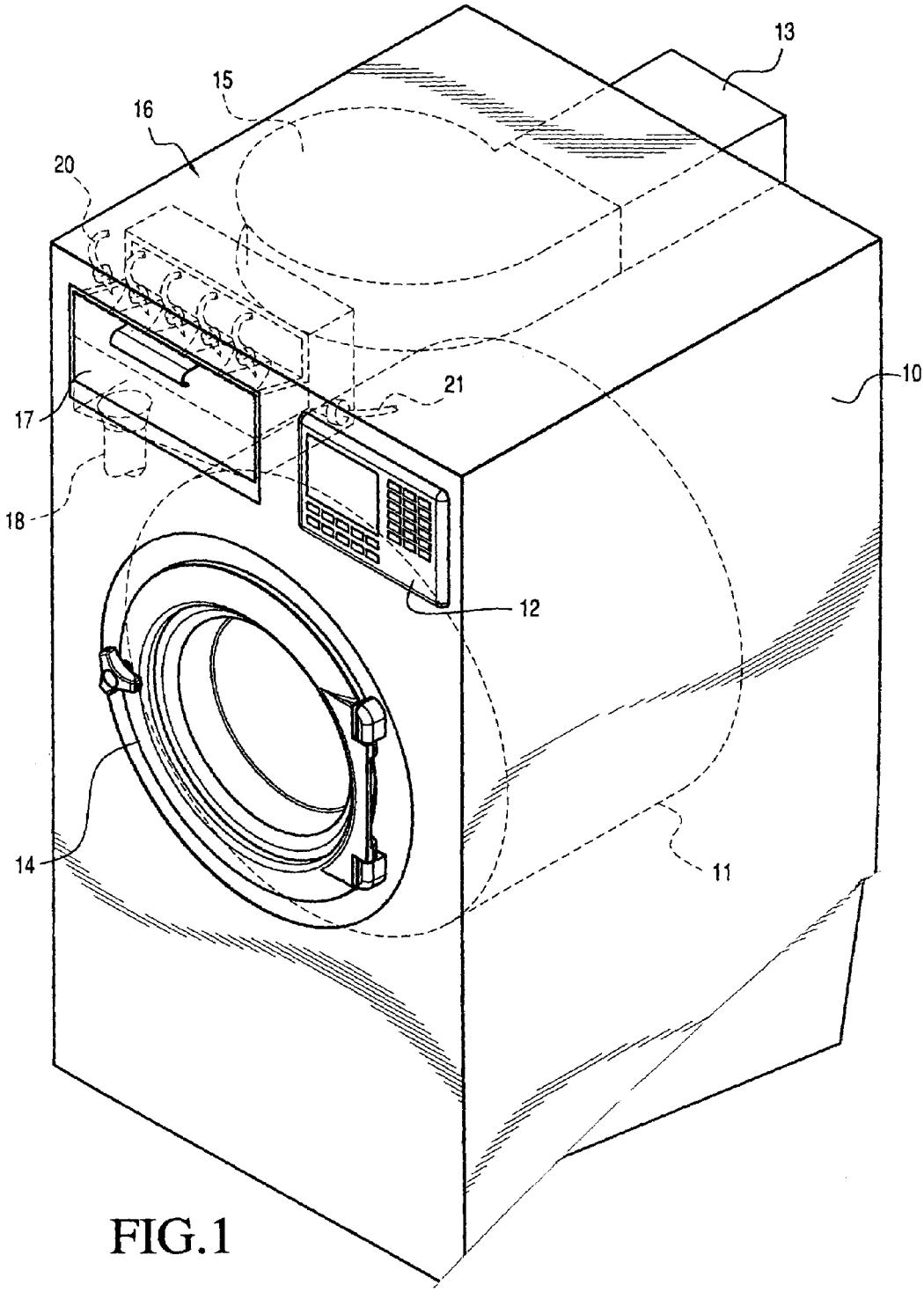
FIG. 1 is a perspective view of a washer/dryer in accordance with a preferred embodiment of the invention.

Referring now to FIG. 1, a perspective view of a washer/dryer in accordance with a preferred embodiment of the invention is shown. A housing 10 encloses a containment drum 11 which is open through the housing 10 and sealed by a door 14. The containment drum 11 includes a rotating perforated basket 40 inside of a water plenum used for both washing and drying functions of fabrics which are loaded through the door 14. Exhaust fan 15 provides a negative pressure to draw the moist drying air from containment drum 11, and expelling the drying air through the exhaust 13 during the drying cycle.

A washing agent container 16 receives washing detergent, bleach, and other washing agents through door 17, and as in a conventional washer, hose 18 carries the contents of the washing agent container 16 to the containment drum 11. The plurality of water jets 20 are cyclically operated by controller 12 to wash the contents of each compartment of the washing agent container 16 through the outlet hose 18. Jet 21 periodically flushes the washing agent container 16.

Figure 8:
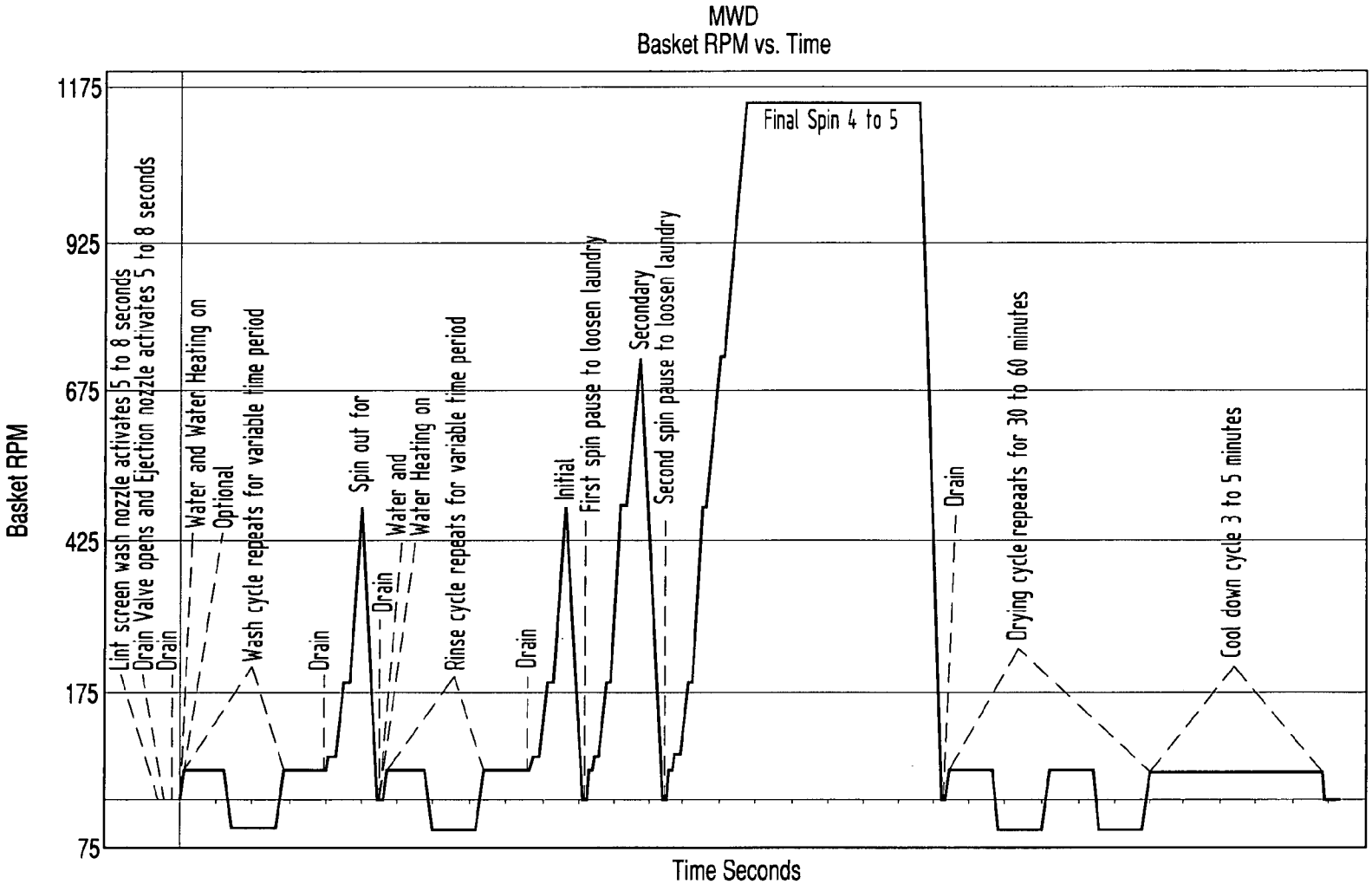
FIG. 8 illustrates the washer/dryer cycle as a function of the clothes basket RPM.

Controller 12 provides commands to a motor drive for rotating the basket within containment drum 11 in both washing and drying cycles to produce the washing/drying cycle of FIG. 8. Additionally, the controller 12 commands an on-board heater to generate heat at the appropriate times during the washing and drying cycles. Temperature sensors within the exhaust 13 and containment drum 11 provide feedback to the controller 12 so that temperatures are maintained at predetermined levels which can sanitize the washing load, and which establish optimum drying temperatures while avoiding excessive temperatures which can damage clothing.

Figure 2:
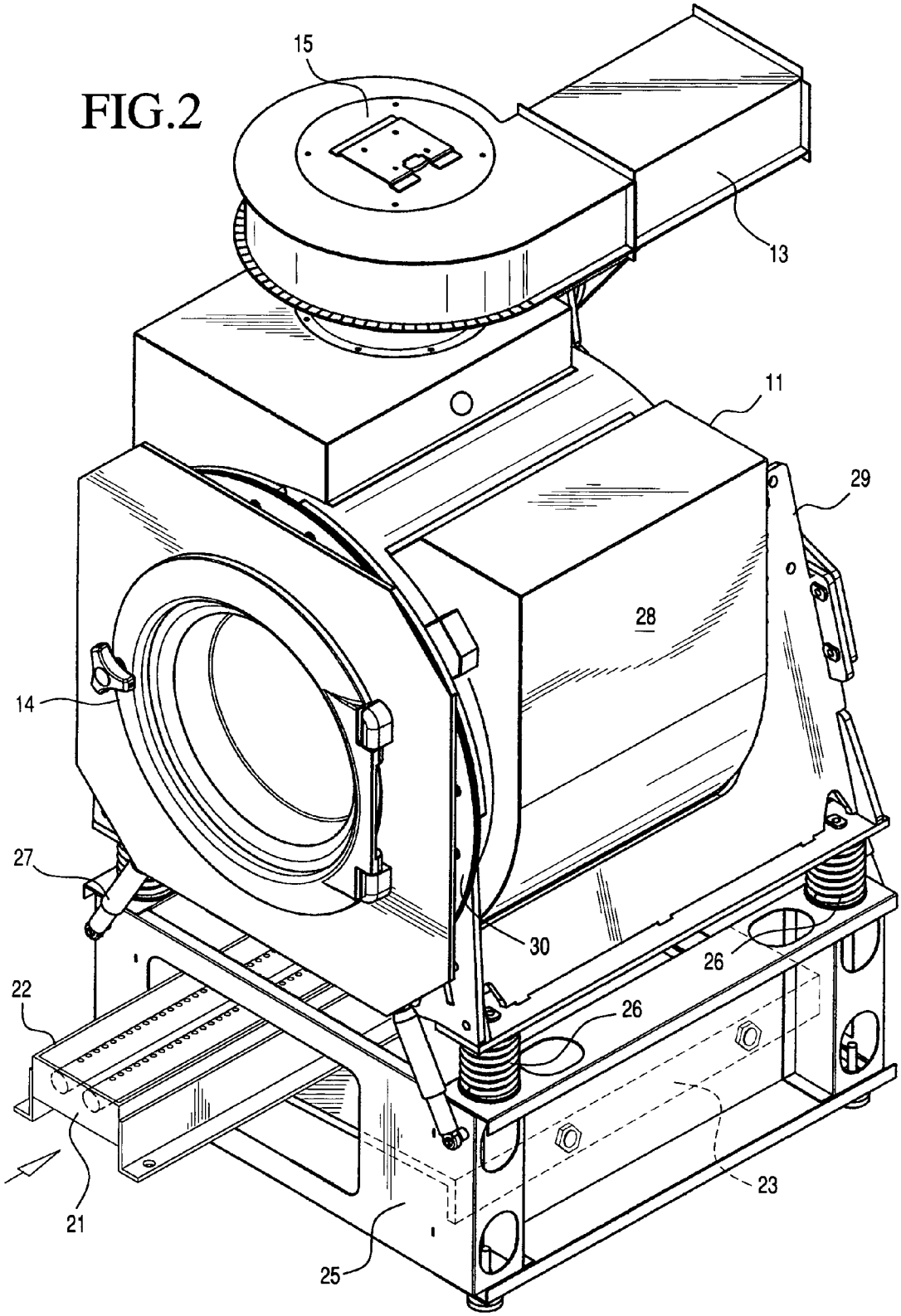
FIG. 2 is a perspective drawing of the washer/dryer containment drum and burner for heating wash water and providing drying air.

FIG. 2 is a perspective view of the washer/dryer with the housing 10 removed. The containment drum 11 is supported in a frame 29. Frame 29 is supported via spring 26 to a base 25. Vibrational forces produced by the rotating basket 40 within containment drum 11 are dampened by shock absorber 27. Additionally, a front face plate 30 of the containment drum supports the sealed door 14.

The burner assembly 22 is supported on a burner support 23 fixed to the base 25. The burner assembly 22 includes burner tubes 21 which supply heat to the containment drum 11 during the washing and drying cycles.

Figure 3:
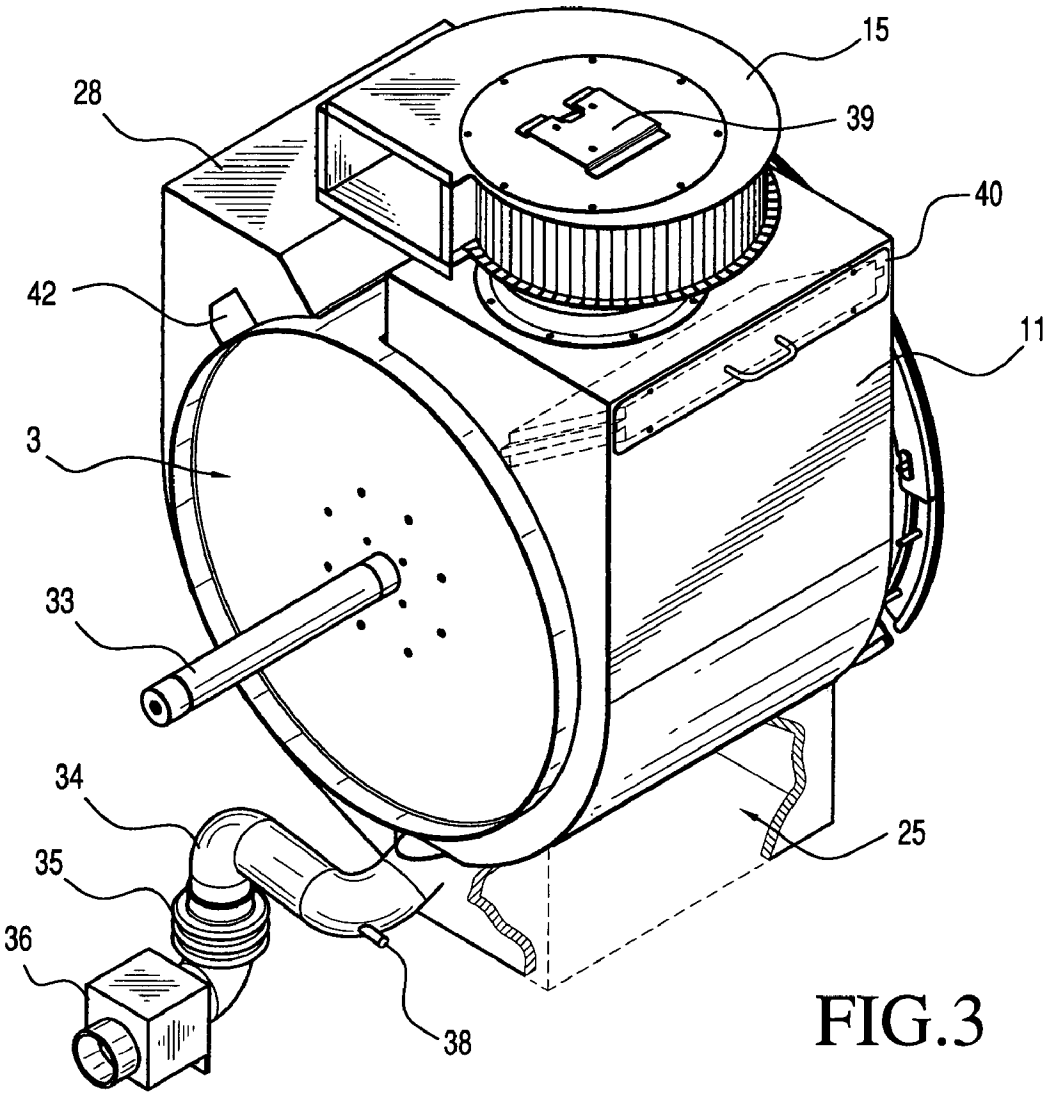
FIG. 3 is a perspective view of containment drum.

FIG. 3 is a rear perspective view of the containment drum 11. The shaft 33 for supporting and driving the rotating basket is coupled to a motor (not shown) operated under control of controller 12. The containment drum 11 has a drain 34 which is coupled via a flexible coupling 35 to a motor operated valve 36. The motor operated valve 36 is also under control of the controller 12 for discharging wash water at the end of a wash cycle, rinse cycle and spin dry cycle. Also shown is flushing port 38 connected to a water supply valve (not shown) which operates under control of controller 12 for periodically providing a jet of water for ejecting the lint washed from the lint screen through the S shaped trap formed by drain 34, flexible coupling 35 and valve 36.

The exhaust fan 15 is shown with the exhaust outlet 13 removed. A drip channel 42 collects water during the spin cycle of the washer/dryer and returns the water back to the water plenum containing the rotating clothes basket.

Figure 4:
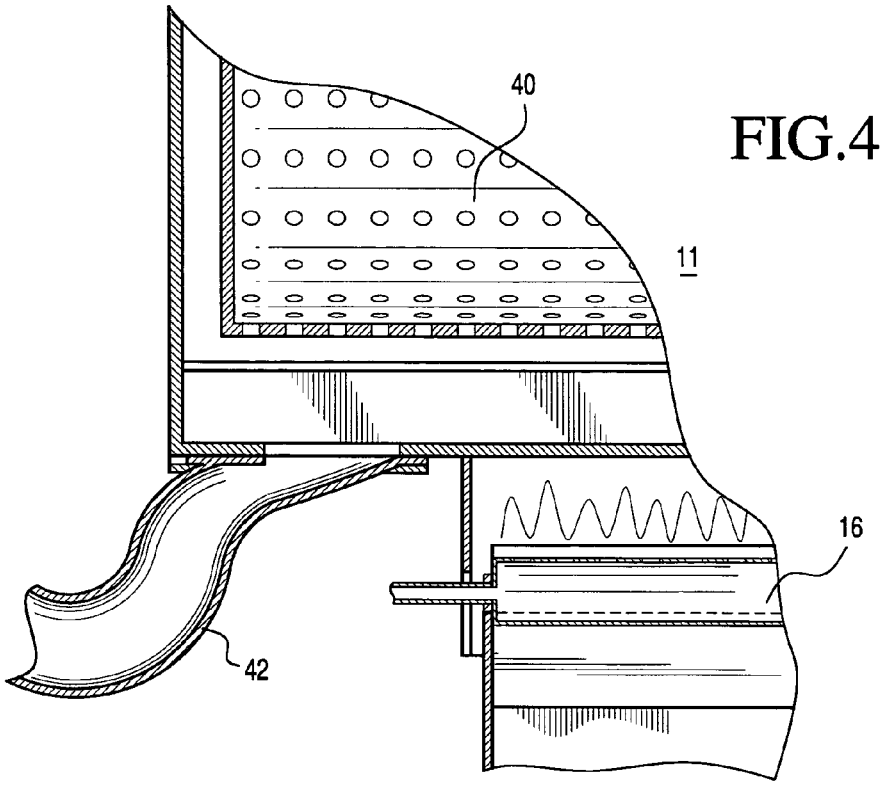
FIG. 4 is a partial section view of the washing agent container and containment drum.
Figure 5:
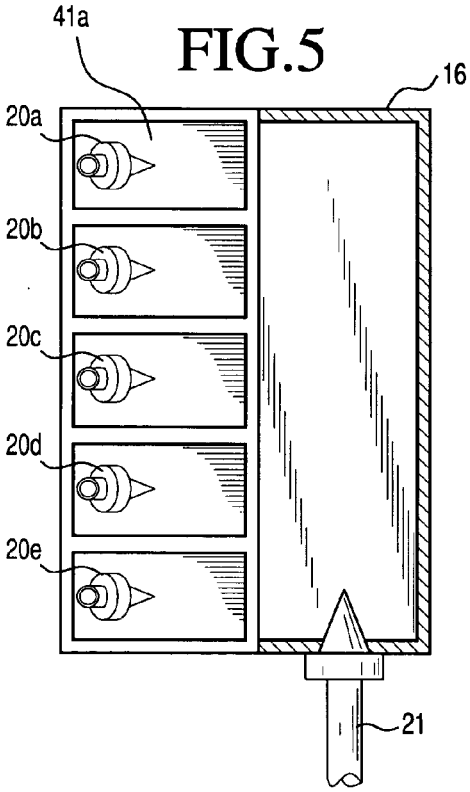
FIG. 5 is a top view of the washing agent container.
Figure 6:
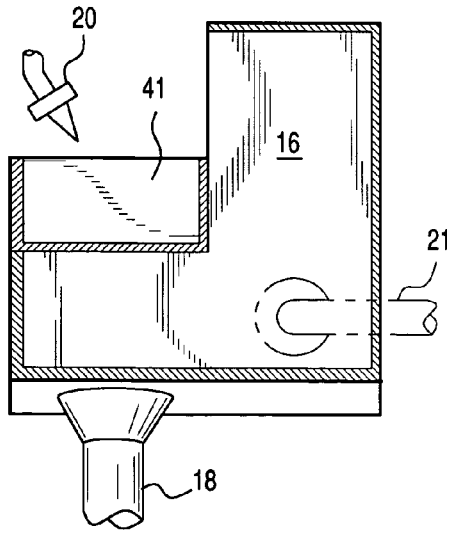
FIG. 6 is a side sectional view of washing agent container.

FIGS. 4–6 are sectional views illustrating the washing agent dispenser compartment 16 with respect to the containment drum 11 and rotating basket 40. A water inlet 24 supplies water through a solenoid valve under control of the controller 12 to the dispenser compartment 16 which drains due to gravity to the containment drum 11 through outlet 18. The various washing agents are placed in each of the removable compartments 41*a*, 41*b*, 41*c*, 41*d*, and 41*e*. Rotation of the door 17 to pivot along the lower edge allows access to the washing agent compartments 41*a*, 41*b*, 41*c*, 41*d*, and 41*e*. Each individual washing agent compartment is arranged below the jets 20*a*, 20*b*, 20*c*, 20*d*, and 20*e*. The controller 12 controls a plurality of solenoid valves connected to the various jets 20 to rinse the compartments 41*a*–41*e* at the appropriate time where washing agents are dispensed through outlet 18 into the containment drum 11.

Figure 7:
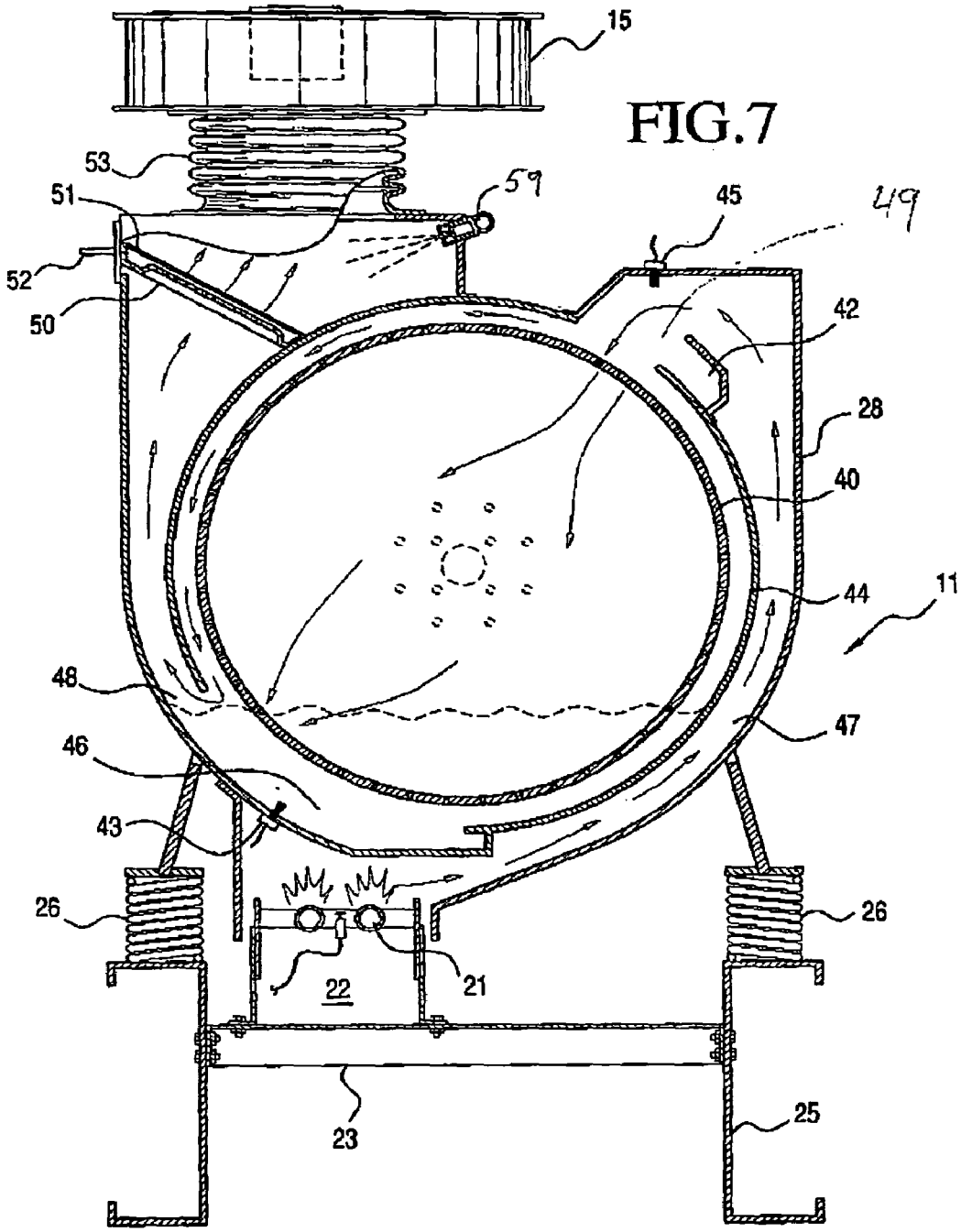
FIG. 7 is a sectional view of the containment drum and burner for heating wash water and supplying drying air.

The operation of the combination washer/dryer is now described with respect to FIGS. 7 and 8. Referring now to FIG. 7, a sectional view of the washer/dryer is shown. The containment drum 11 includes the rotating perforated basket 40 holding the wash load. During the washing cycle, the water level is established within a water plenum 46 in the containment drum as shown. The water plenum 46 is joined at an opening 49 at the top of the water plenum with the hot air supply plenum 47. An opening in the bottom of the water supply plenum 46 is joined with an exhaust plenum 48. During washing, the illustrated water level is confined in the water plenum 46 and the lower portion of the exhaust plenum 48.

Burner assembly 22 is in heat transfer relationship with water plenum 46 within the containment drum 11. The burner 22 is operated cyclically under control of the controller 21 to heat water within the water plenum 46 and lower portion of exhaust plenum 48 to a predetermined programmed temperature level, including a sanitizing level as set forth by various regulatory bodies. A temperature sensor 43 provides temperature feedback information to controller 12 so that the correct temperature is established for the washing solution.

The rotating basket 40 reciprocates as is common in most side loading washing machines for a period of time to efficiently clean the load. Once the wash time has timed out in controller 12, the water is drained from the water plenum 46 through the drain 34, and the washer/dryer enters the first spin drying mode.

As will be clearer with respect to FIG. 8, the rinse cycle re-establishes the water to a predetermined programmed level. Once the wash load is rinsed, the water is again drained, and the washer/dryer enters the final spin drying mode under the control of the controller 12. The basket 40 is rotated at a multiplicity of speeds, coming to rest between each level of rotational velocity so as to prevent the wash load from adhering to the circumference of the clothes basket 40.

The centrifugally wrung wash load has approximately 50% of the moisture removed from the wash load. During the centrifugal drying of the wash load, moisture spun from the clothes basket 40 may collect in channel 42 where it is returned by gravity to the water plenum 46 and to the drain 34.

The drying cycle utilizes heat from burner 22 under control of the controller 12 to dry the moisture laden wash load. The hot air supply plenum 47 is formed between the outside wall 28 of the containment drum 11 and a wall 44 of the water plenum 46. Hot air from the burner 22 rises through the hot air supply plenum 47 and enters the perforated clothes basket 40 at the top of the hot air supply plenum 47 through an opening 49 in the top of water supply plenum 46. The hot moisture laden drying air is then withdrawn through the bottom of the clothes basket 40 through exhaust plenum 48. The exhaust plenum 48 extends vertically from lower opening in water plenum 46 substantially diametrically opposite the end of the hot air supply plenum 47. Fan 15 applies a negative pressure to the opposite end of the exhaust plenum 48 drawing moisture laden air from the perforated clothes basket 40 through the exhaust plenum 48. The temperature of the drying air is monitored by sensor 45 which is connected to the controller 12 and is disposed at the top of the hot air supply plenum. The drying air temperature is regulated by controller 12 which cycles burner 22 in response to the measured air temperature so as not to exceed a predetermined programmed limit which will damage the wash load 7. Since the initial conditions for drying including the moisture content of the load are fairly constant between loads, controller 12 may enter a drying routine with a drying temperature profile at its maximum drying efficiency and below a level which will damage the wash load.

A feature of the embodiment in accordance with FIG. 7 includes a lint trap having a filter 51 supported on a tray 50 which can be removed via handle 52 from the exhaust plenum for periodic inspection. Additionally, prior to starting the wash cycle, a water jet 59 may be operated by controller 12 to direct water on the filter forcing lint from the underside of filter 51. The lint collects in a water pool at the bottom of water compartment 46. Drain valve 36 is opened by controller 12 and a solenoid operates water valve connected to nozzle 38 is opened forcing the lint load and water to be ejected through drain 36.

The washer/dryer in accordance with FIG. 7 maybe advantageously operated to provide for a wash/drying cycle under control of controller 12 as shown in FIG. 8 where the wash/dry cycle for the washer/dryer is illustrated with respect to the clothes basket 40 RPM.

The temperature for drying may be optimized for the finished wash load. Since the moisture content is at a known predetermined level, the drying temperature can be safely raised to a higher level than was previously utilized without incurring unacceptable risks of a fire or damage to a wash load.

The sequence of washing and drying begins by activating jet 59 for 5–10 seconds thereby forcing any lint collected on the lint filter 51 into the water plenum 46 and into the drain 34. The drain valve 36 is opened by controller 12, and the ejection nozzle 38 supplies a high velocity stream of water for 5–8 seconds flushing any collected residue through the drain 34.

Following the cleansing of the lint filter 51 and operation of the drain valve, the containment compartment water plenum 46 is filled with wash water to the level shown in FIG. 7 by controller 12 to a predetermined programmed level. The controller 12 then enters a heating mode and enables burner assembly 22 to heat the water in water compartment 46 until the desired temperature is reached.

A wash cycle is entered and the basket is alternately rotated in each direction for a period of time selected by the user through controller 12. Following the wash cycle, the drain valve 36 is opened and water drains from the water compartment 46. The machine may then enter a spin cycle to centrifugally force water from the clothes into the drain 34.

A rinse cycle commences for a period of time set in controller 12. The water plenum 46 is refilled and the water is heated to an appropriately selected temperature set by controller 12. The clothes basket 40 is then rotated in alternate directions for the duration of the rinse cycle. Following the rinse cycle, the drain valve 36 is reopened to drain the rinse water.

The spin cycle centrifugally removes 50% of the moisture in the load by initially rotating the clothes basket 40 at about 450 RPM. In order to prevent caking of the laundry load along the surface of the rotating basket 40, a first pause is entered in the spin cycle for 5–10 seconds, wherein, in the preferred embodiment, the clothes basket 40 stops rotating. At this time, the clothes will drop from the exterior surface of the clothes basket 40 due to the force of gravity. The clothes basket is then operated at a second RPM, at least as high as the initial RPM of 450 RPM, but preferably at a higher RPM of about 750 RPM, to continue centrifugally drying the clothes. The spin cycle is again paused, to permit the clothing to drop from the surface of the clothes basket 40 preventing caking of the clothes to the surface of clothes basket and clumping together in a compact mass. Following a second pause of 5–10 seconds, the clothes basket is rotated through multiple steps to a final spin RPM. The final spin interval, being longer than the first two spin intervals, lasts approximately 4–5 minutes.

The foregoing sequence produces a load of an approximate known moisture content. The beginning of the final heated drying cycle therefore represents moisture conditions which are predetermined and constant from load-to-load. Accordingly, from the known starting point of moisture content, it is possible to select a final optimum drying temperature profile to minimize the time for drying, while maintaining a safe temperature margin for the wash load.

The heated drying cycle begins by actuating valve 36 by closing the drain. The drying cycle may be of the reversing type, wherein the clothes basket 40 is rotated in alternate directions for a predetermined period of time. Following a drying cycle of 30–60 minutes, a cool down cycle is begun wherein the temperature profile of the load is decreased for 3–5 minutes to reduce the possibilities of spontaneous combustion of line lints.

The completion of the drying cycle is signaled by the controller 12 to the facilities operator. From the beginning to end, operator intervention was unnecessary, and personnel involved in the laundry facility are permitted to engage in other tasks. Since the complete washing/drying cycle is automated, maximum throughput efficiency for the facility may be obtained.

The foregoing description of the invention illustrates and describes the present invention. Additionally, the disclosure shows and describes only the preferred embodiments of the invention in the context of a combination washer/dryer having common heat source, but, as mentioned above, it is to be understood that the invention is capable of use in various other combinations, modifications, and environments and is capable of changes or modifications within the scope of the inventive concept as expressed herein, commensurate with the above teachings and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form or application disclosed herein. Also, it is intended that the appended claims be construed to include alternative embodiments.

What is claimed is:

1. A combination washer dryer comprising:

a containment drum having a water supply plenum having an inlet for receiving wash water and an outlet for discharging said wash water;

a perforated clothes drum supported for rotation within said water supply plenum;

a source of heat coupled to supply heat to water in said water supply plenum;

a hot air supply plenum coupled to said source of heat, partially extending around one side of said water supply plenum to a first opening in said water supply plenum above a water level in said water supply plenum; and an exhaust plenum extending from a second opening in said water supply plenum along an opposite side of said water supply plenum to an exhaust chamber, wherein following a washing cycle, said containment drum is emptied and hot air circulates during a drying cycle from said hot air supply plenum through said water supply plenum to said exhaust plenum drying clothes in said perforated clothes drum.

2. The combination washer dryer of claim 1 further comprising a blower coupled to said exhaust plenum for creating a draft in said exhaust plenum.

3. The combination washer dryer of claim 1 wherein said first and second openings are diametrically opposite each other.

4. The combination washer dryer of claim 1 further comprising S trap-shaped outlet connected to said drain for discharging wash water.

5. A combination washer dryer comprising:

a containment drum having a water supply plenum having an inlet for receiving wash water and an outlet for discharging said wash water;

a perforated clothes drum supported for rotation within said water supply plenum; a source of heat having a fire box communicating with said containment drum for heating said containment drum wash water during a washing cycle, and for supplying hot hair during a drying cycle;

a drying air plenum connected to receive said drying air and delivering said drying air to an first opening in said water supply plenum during a drying cycle;

an exhaust plenum connected to a second opening in said water supply plenum for discharging drying air passing through said perforated clothes drum; and a lint filter disposed in said exhaust plenum for collecting debris contained in said drying air.

6. The combination washer dryer according to claim 5 further comprising: means for periodically cleaning said filter.

7. The combination washer dryer according to claim 5 further comprising a drain coupled to said outlet and said exhaust plenum for collecting lint from said filter and wash water from said outlet.

8. A combination washer-dryer comprising:

a base supporting a burner for heating water for a washing cycle and air during a drying cycle;

a containment drum assembly supported to said base, said containment drum having a door closing an opening to receive clothes to be washed, and having a water inlet for receiving wash water and outlet for discharging wash water, said assembly comprising;

a rotating clothes basket supported for rotation along a horizontal axis in said containment drum assembly;

a water plenum extending around a portion of the rotating clothes basket and in heat transfer relationship with said burner, said water plenum having an inlet for receiving said washing water and an outlet for discharging wash water;

an exhaust chamber connected to a bottom of said water plenum for discharging moisture laden drying air; and a heating air chamber extending from an opening in the top of said water plenum to said burner for delivering drying air to clothes in said clothes basket which exits through said clothes basket to said exhaust chamber.

9. The combination washer-dryer according to claim 8 further comprising a controller which provides control over rotation of said drum so that during a spin cycle said drum is rotated at a plurality of speeds to prevent said clothes from forming clumps which are difficult to dry.

10. The combination washer-dryer according to claim 9 wherein said controller prior to entering a drying cycle alternately spins said clothes at higher and lower speeds.

11. The combination washer-dryer according to claim 10 wherein said controller progressively increases said higher speeds.

* * * * *